US005565953A

United States Patent [19]

Fukushima et al.

[11] Patent Number: 5,565,953

[45] Date of Patent: Oct. 15, 1996

[54] PHOTOGRAPHIC PROCESSING MACHINE

[75] Inventors: Shinji Fukushima; Masayuki Kojima; Mitsuji Kawashima; Hisashi Negoro; Yutaka Kiyonaga; Shigeru Masuda, all of Wakayama, Japan

[73] Assignee: Noritsu Koki Co., Ltd., Wakayama, Japan

[21] Appl. No.: 313,573

[22] Filed: Sep. 23, 1994

[30] Foreign Application Priority Data

| | | | |
|---|---|---|---|
| Sep. 24, 1993 | [JP] | Japan | 5-238288 |
| Sep. 24, 1993 | [JP] | Japan | 5-238336 |
| May 20, 1994 | [JP] | Japan | 6-107081 |

[51] Int. Cl.[6] ..... G03D 3/08

[52] U.S. Cl. ..... 396/620; 396/622; 396/617

[58] Field of Search ..... 354/319–324, 354/338–340, 308, 310–312; 226/118, 119; 355/27–29, 40, 41

[56] References Cited

U.S. PATENT DOCUMENTS

| | | | |
|---|---|---|---|
| 4,857,950 | 8/1989 | Takase et al. | 354/324 |
| 4,864,354 | 9/1989 | Crasnianski | 354/322 |
| 4,930,672 | 6/1990 | Renzo | 226/119 |
| 4,967,222 | 10/1990 | Nitsch | 354/321 |
| 5,307,114 | 4/1994 | Nitsch et al. | 355/29 |

FOREIGN PATENT DOCUMENTS

| | | | |
|---|---|---|---|
| 3623084 | 1/1987 | Germany . | |
| 4110642 | 10/1992 | Germany . | |
| 4-141646 | 5/1992 | Japan | 354/323 |
| 91/20016 | 12/1991 | WIPO . | |

OTHER PUBLICATIONS

Patent Abstracts of Japan, vol. 16, No. 421 (P–1414) Sep. 4, 1992.

*Primary Examiner*—D. Rutledge
*Attorney, Agent, or Firm*—Wenderoth, Lind & Ponack

[57] ABSTRACT

Extra printing is made possible during a set of ordinary processing operations such as film development and printing. A film is developed and dried while being fed by a leader attached thereto. After cutting the leader from the film, it is fed to the printing unit to print the images on the film onto photographic paper. A plurality of film stocking units are provided in a path from the film drying unit to the printing unit. Each stocking unit can selectively stock a single film or allow it to pass without stocking. A second film stocking unit can move laterally to change the film track. If a film requiring a long exposure time is present in the printing unit, the subsequent films that have been developed and dried can be stocked in the other film stocking units. Thus, continuous film developing operations are not interrupted.

4 Claims, 19 Drawing Sheets

PHOTOGRAPHIC PROCESSING MACHINE

BACKGROUND OF THE INVENTION

This invention relates to a photographic processing machine for automatically developing and drying film, printing images on films onto photographic paper, and developing and drying the photographic paper.

As shown in FIGS. 18 and 19, this type of photographic processing machine has a film developing unit A comprising a plurality of treating tanks, a film drying unit B, a printing unit C, a printed paper developing unit D having a plurality of treating tanks, and a printed paper drying unit E. Films F are fed through the units A, B and C. Web of photographic paper P is fed through the units C, D and E. While feeding films and photographic paper, the films are developed and dried and the images thereon are printed onto the photographic paper. The thus printed photographic paper is developed and dried. These steps are all carried out automatically. In the device shown in FIG. 18, the film feed path G extending from the film drying unit B to the printing unit C is located right over the film drying unit B. In the device shown in FIG. 19, the film feed path G extends straight ahead from the unit B.

Films F are fed at different speeds and in different manners in the film developing unit A and the film drying unit B than in the printing unit C. Films are fed continuously in the units A and B, while in the unit C, films are intermittently fed frame by frame. Thus, the feed of each film has to be temporarily stopped before feeding it from the unit B to the unit C. For this purpose, a film stocking unit Q is provided downstream of the film drying unit B. Each developed and dried film is stocked temporarily in the film stocking unit Q until the printing of the preceding film F in the unit C is complete.

Since such a film stocking unit Q is used merely to stop the feed of film temporarily, it can stock only one film. This arrangement poses a problem if it takes a long time for the exposure of the film in the printing unit C. More specifically, the time needed to expose each film in the printing unit C varies according to its shooting conditions. If a film in the printing unit C requires a long exposure time, even though a second film F is being stocked in the film stocking unit Q, a third film that follows the second film F may be guided into the unit Q.

Since the developing time is fixed, it is impossible to keep films in the developing/drying unit too long. Thus, the third film has to be fed into the film stocking unit Q. Since the unit Q can stock only one film, the second film has to be fed to the printing unit C. As a result, the first film in the printing unit C has to be discharged from the printing unit C before printing all the frames.

The film F discharged from the printing unit C before having all its frames printed has to be fed back into the printing unit C for printing and subsequent treatments. This process, called "make-over", has to be carried out interrupting the normal continuous, automatic process. The operating efficiency thus worsens.

Films F that require extra printing or other post-printing treatments have to be fed into the printing unit C through a film inlet 14*a*.

Since a conventional device can stock only one film to feed film intermittently for printing, it was impossible to print another film. Thus, extra printing was possible only while films were not being developed.

A first object of this invention is to provide a photographic processing device which can prevent films F from being discharged from the printing unit C without having all their frames printed.

A second object is to provide a photographic processing device in which extra printing can be carried out while films are being developed and dried.

SUMMARY OF THE INVENTION

In order to achieve the first object, according to this invention, there is provided a photographic processing machine comprising a film developing unit, a film drying unit, a printing unit, a photographic paper developing unit and a photographic paper drying unit, wherein a film is fed through the film developing unit and the film drying unit to develop and dry the film, and wherein photographic paper is fed through the printing unit, photographic paper developing unit and photographic paper drying unit to print images on the film onto the photographic paper and to develop and dry the photographic paper, characterized in that a plurality of film stocking units are provided in a film feed path from the film drying unit to the printing unit, the each film stocking unit being capable of selectively stocking a film or feeding a film ahead without stocking.

In another arrangement, a film inlet formed in the film developing unit, the film developing unit and the film drying unit are arranged along a straight line, and wherein a film feed path is provided parallel to the straight line that extends through the film developing unit and film drying unit, wherein one of the film stocking units is provided downstream of the film drying unit, the one film stocking unit being movable along an axis aligned with the film feed path, and wherein the film feed path extends to a film inlet formed in the printing unit, other film stocking units and being provided in the film feed path.

In order to achieve the second object, there is provided a photographic processing machine wherein the printing unit has a film inlet for inserting films for extra printing or make-over in addition to the film inlet for ordinary printing.

One of the film stocking units stocks a film until the preceding film is printed in the printing unit. In an ordinary photo-processing mode, the other film stocking units do not stock films but let them pass by. If leaders are attached to films, they are cut apart from the films after they have been developed and dried.

If a film requiring a long time for the exposure of the film is present in the printing unit and the one film stocking unit is occupied, the films that have been developed and dried are not fed to the abovementioned one film stocking unit but kept in the other film stocking units. Thus, there is no need to discharge the film in the printing unit before printing all its frames.

Thereafter, films are printed continuously. If the development of films becomes intermittent, the films stocked in the other film stocking units are fed one after another into the printing unit, so that printing can be done continuously.

By providing a film inlet for inserting films for extra printing or make-over, it is possible to insert films for extra printing or make-over into the printing unit for printing while interrupting the feed of films from the film stocking units to the printing unit. While printing these films, the developed and dried films are stocked in the other film stocking units. Thus, there is no need to stop the film developing and drying operations. After extra printing or making-over is finished, the films stocked in the film stocking units are again fed into the printing unit continuously.

According to this invention, since more than one film can be stocked at a time, it is possible to minimize the number of films that are discharged from the printing unit before all the frames have been printed, even if a rather long time is taken for exposure. The operating efficiency is thus high.

By providing a film inlet for inserting films for extra printing, it is possible to insert such films, interrupting the ordinary photo-treatment processes. Thus, the operating efficiency improves still further.

fin another arrangement, two film feed paths are provided parallel to each other and films are fed from one feed path to the other by moving the film stocking unit. This makes it possible to reduce the size of the entire device.

Other features and objects of the present invention will become apparent from the following description made with reference to the accompanying drawings, in which:

DETAILED DESCRIPTION OF THE PREFERRED EMBODIMENT

Figure 5:
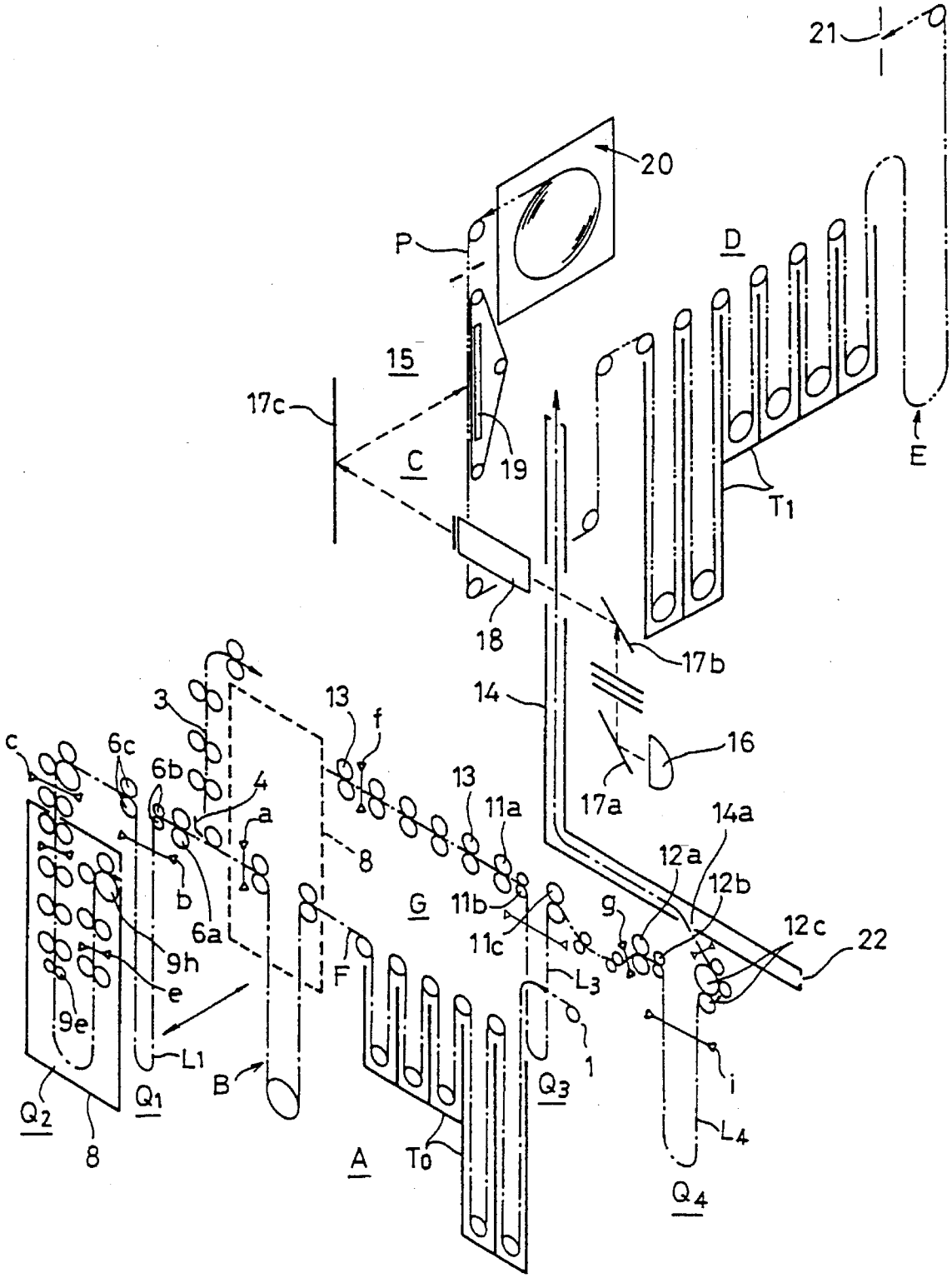
FIG. 5 is a schematic perspective view of the same.

FIGS. 1–8 show one embodiment of this invention. FIG. 5 schematically shows this embodiment. A film F is fed manually into the film developing unit A through its film inlet 1. It is then automatically developed by being fed through treating solutions in a plurality of treating tanks $T_0$. The film F thus developed is fed into the film drying unit B and dried. After drying, it is fed toward a first film stocking unit Q1.

Figure 1:
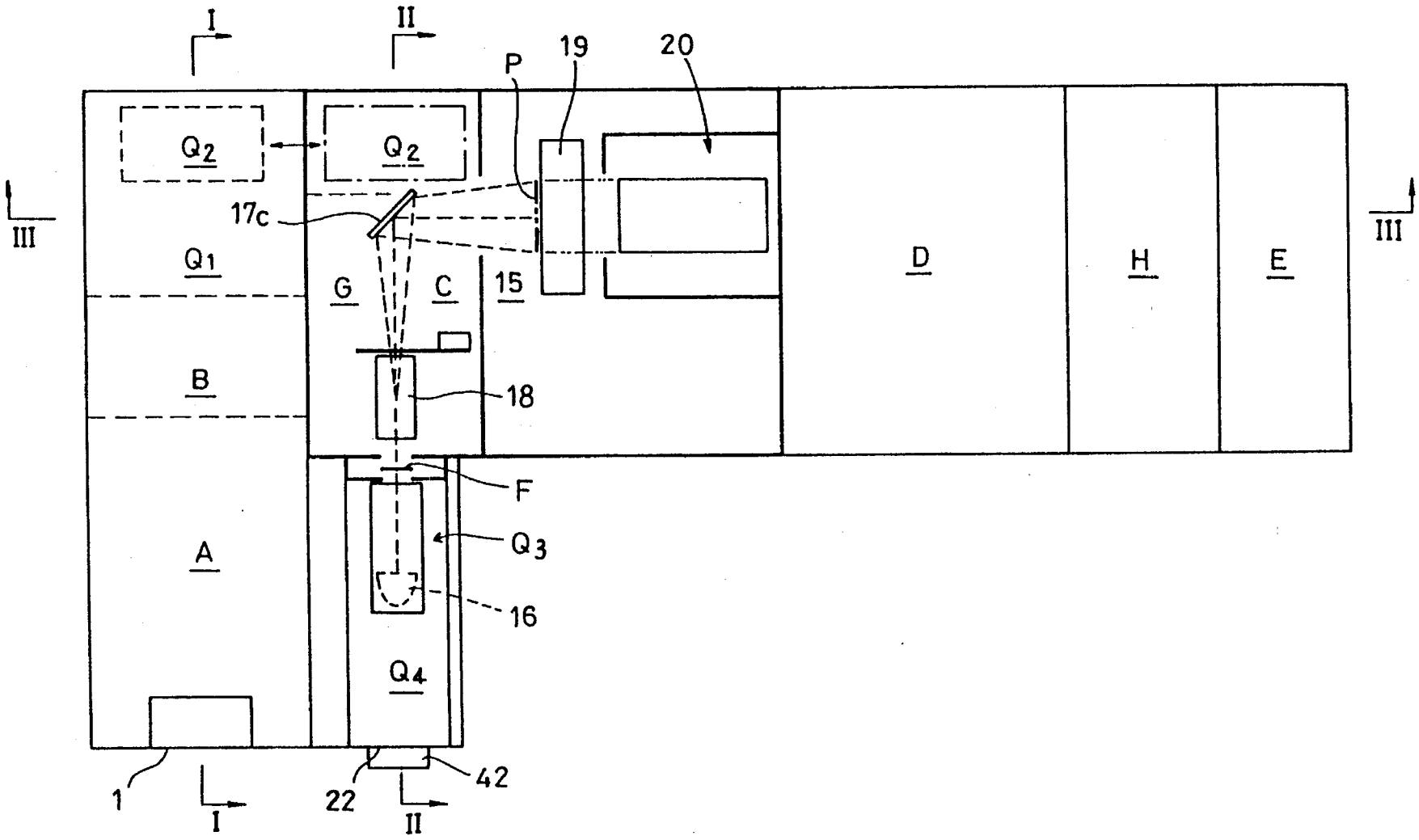
FIG. 1 is a plan view of one embodiment.
Figure 2:
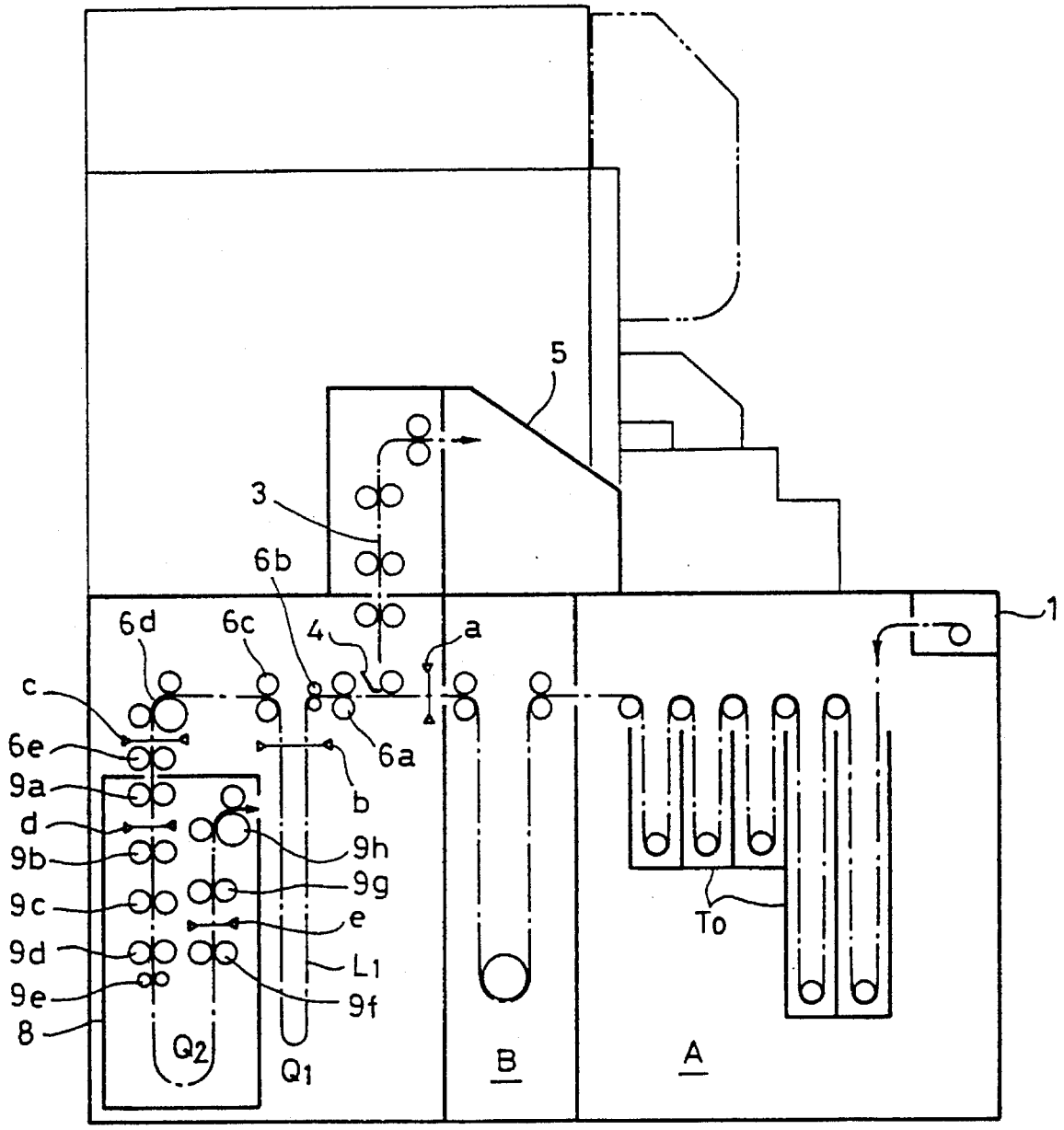
FIG. 2 is a sectional view taken along line I—I of FIG. 1.
Figure 6:
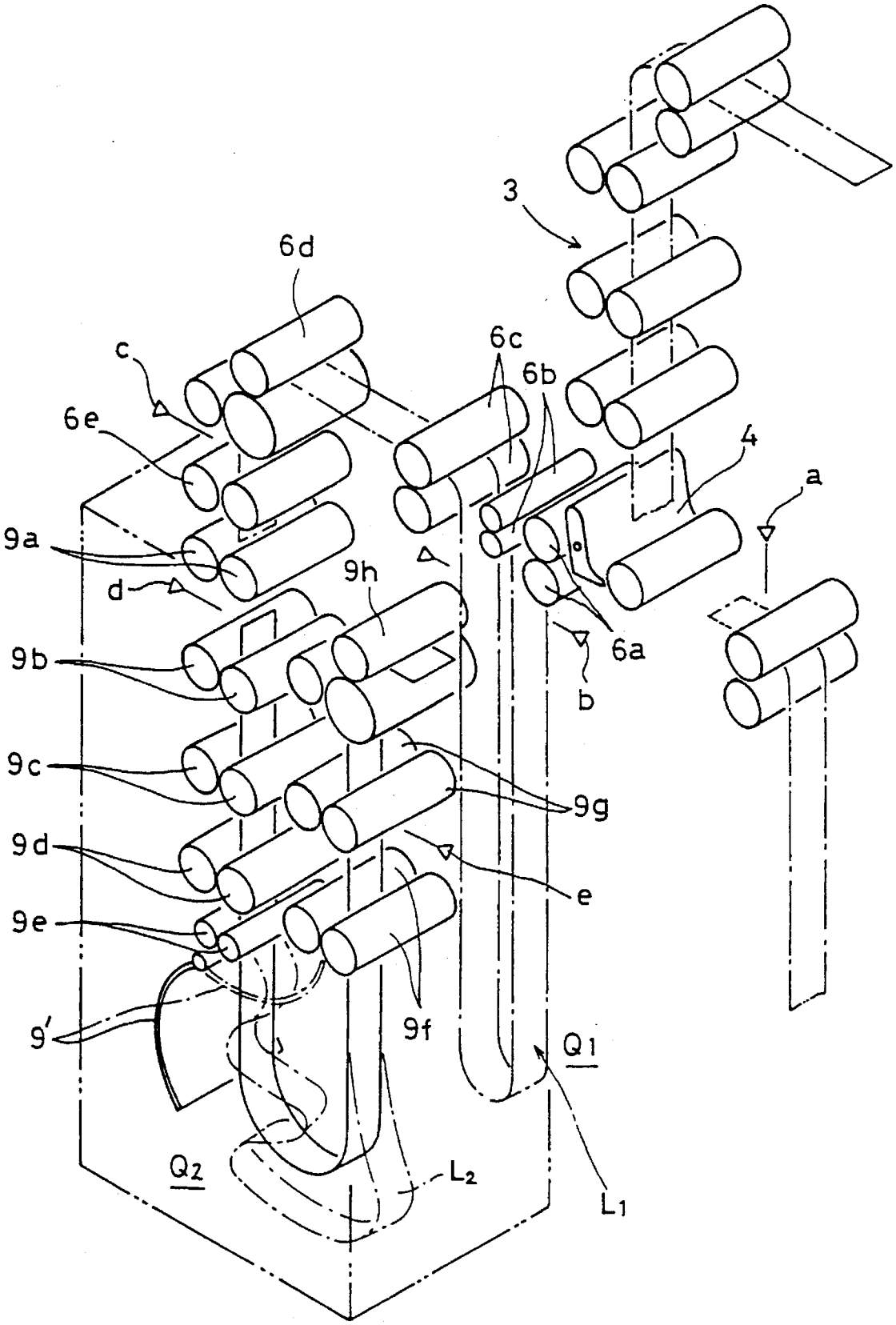
FIG. 6 is a perspective view of a portion of the same.
Figure 7A:
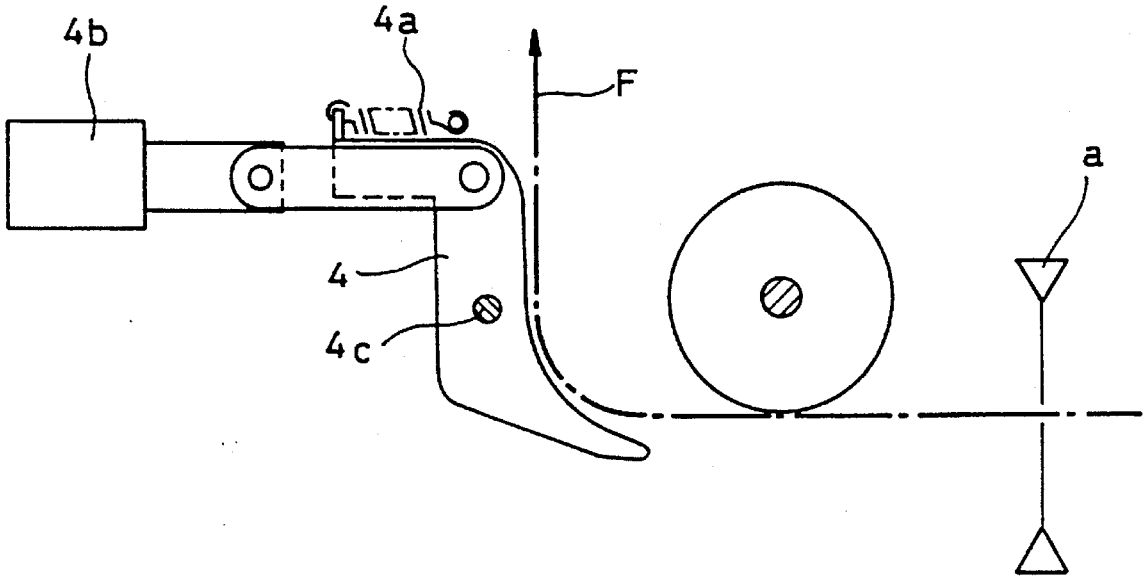
FIGS. 7A and 7B are views that show the operation of the same.

Upstream of the film stocking unit Q1 is a changeover guide 4 for changing over the feed direction toward a film discharge route 3 (see FIGS. 5–7). The changeover guide 4 is normally urged downward about a pivot center 4*c* by a spring 4*a* as shown in FIG. 7A so that its free end is located along the feed path of the film F. The film F is thus fed into the film discharge route 3 and then into a film stocker 5 (FIG. 2). Films are fed in this direction when films are only to be developed or if any unit in a later stage such as the first film stocking unit Q1 should fail. Films can be discharged manually from the film developing unit A through the changeover guide 4 into the film stocker 5 in case of e.g. power failure.

Figure 7B:
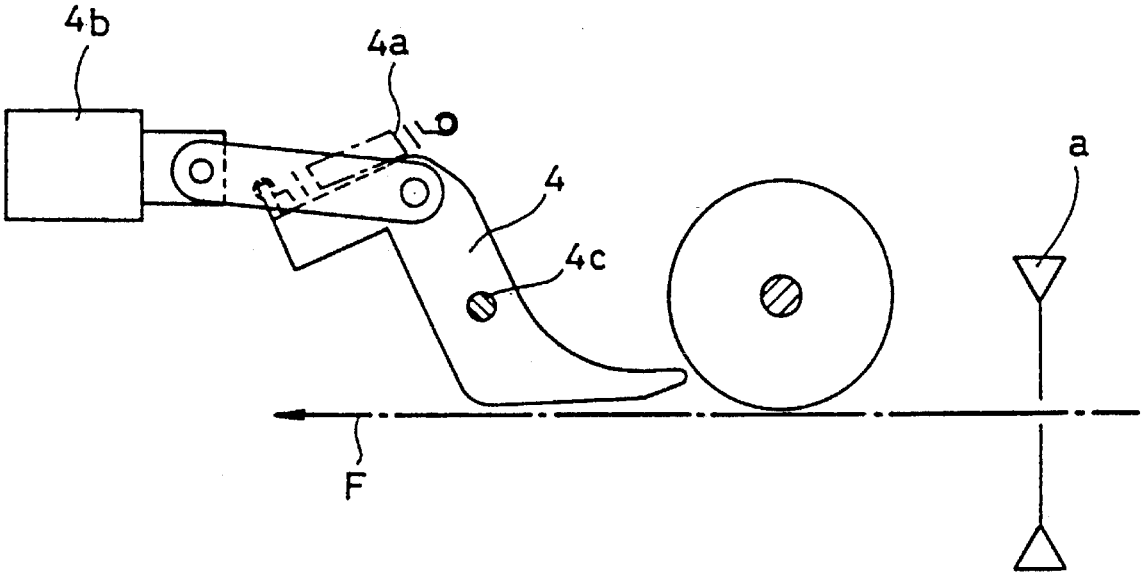

On the other hand, when developing and then printing films, the changeover guide 4 is turned by a solenoid 4*b* as shown in FIG. 7B as soon as the leading end of film F is detected by a sensor a located immediately before the guide 4 so that its free end moves out of the film feed path. The film F is thus fed straight ahead to the first film stocking unit Q1.

The first film stocking unit Q1 has a plurality of pairs of feed rollers 6 that are arranged in one direction. The film F is fed in one direction or forms a loop L1 by turning or stopping feed rollers 6*a*, 6*c*.

Namely, as shown in FIGS. 5 and 6, after passing through the changeover guide 4, the film F is fed straight ahead by the feed rollers 6*a* and 6*c* and then turned downwards by a feed roller 6*d*. After its leading end has been detected by a sensor c, the film is further fed a predetermined distance. When the film leading end is caught between feed rollers 6*e*, the feed rollers 6*c* and 6*d* are stopped. On the other hand, the feed rollers 6*a* keep rotating, feeding the film F ahead. Thus, the loop L1 is formed. Even after the rear end of the film F has passed by the feed rollers 6*a*, the film is still held between free press rollers 6*b*. The loop L1 is thus maintained. The rollers are driven by a pulse motor.

When a second film stocking unit Q2 is in a predetermined position (shown by solid lines in FIG. 5), the feed rollers 6*c*, 6*d* and 6*e* begin turning when the sensor a detects the rear end of the film F or when the sensor b confirms the loop L1. The film F is thus fed into the second film stocking unit Q2. On the other hand, if the unit Q2 is not in the predetermined position, the loop L1 is formed and maintained. In this state, when the second film stocking unit Q2 moves to the predetermined position, the film F is fed into the unit Q2.

Figure 8:
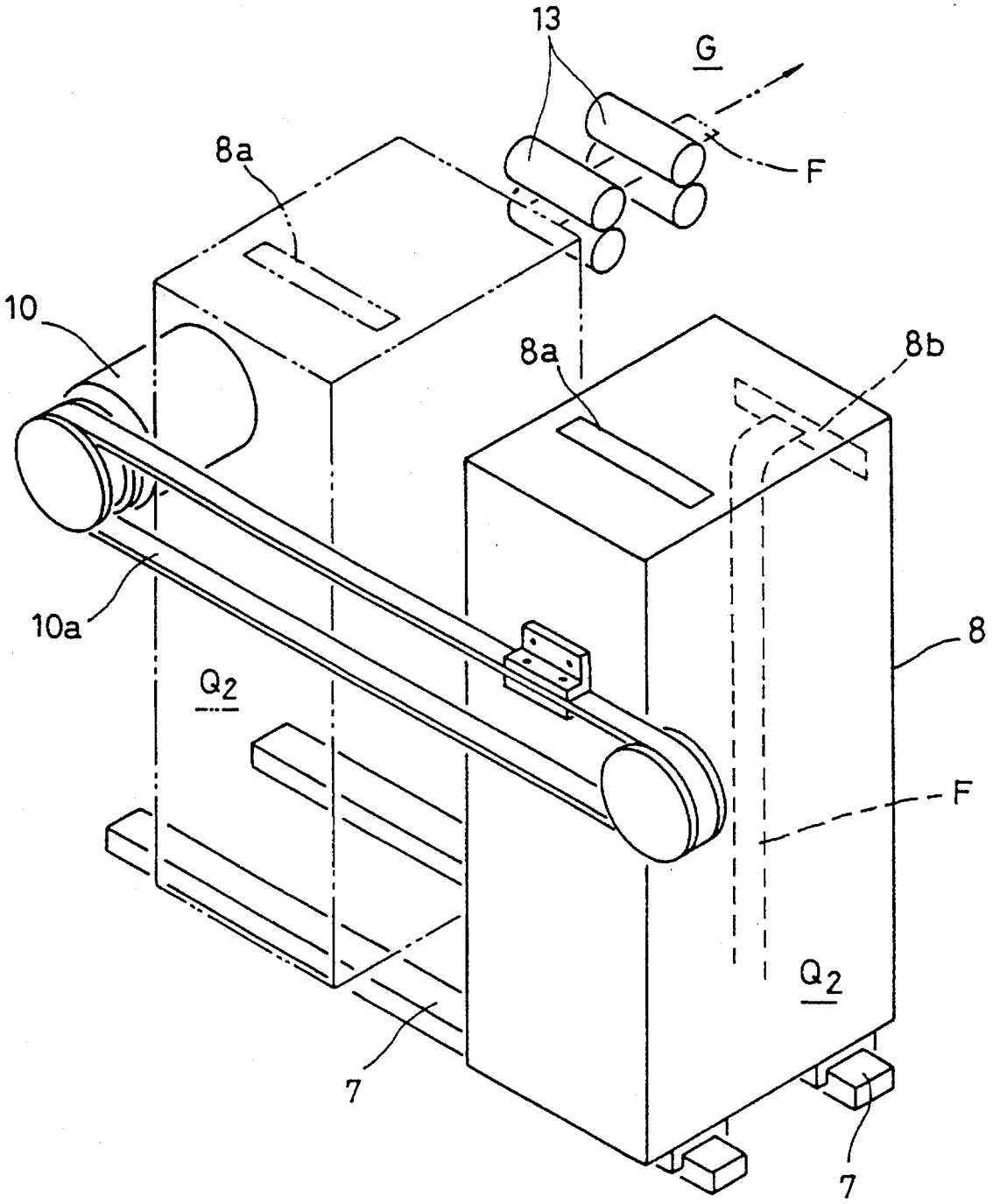
FIG. 8 is a schematic perspective view of a portion of the same.
Figure 9:
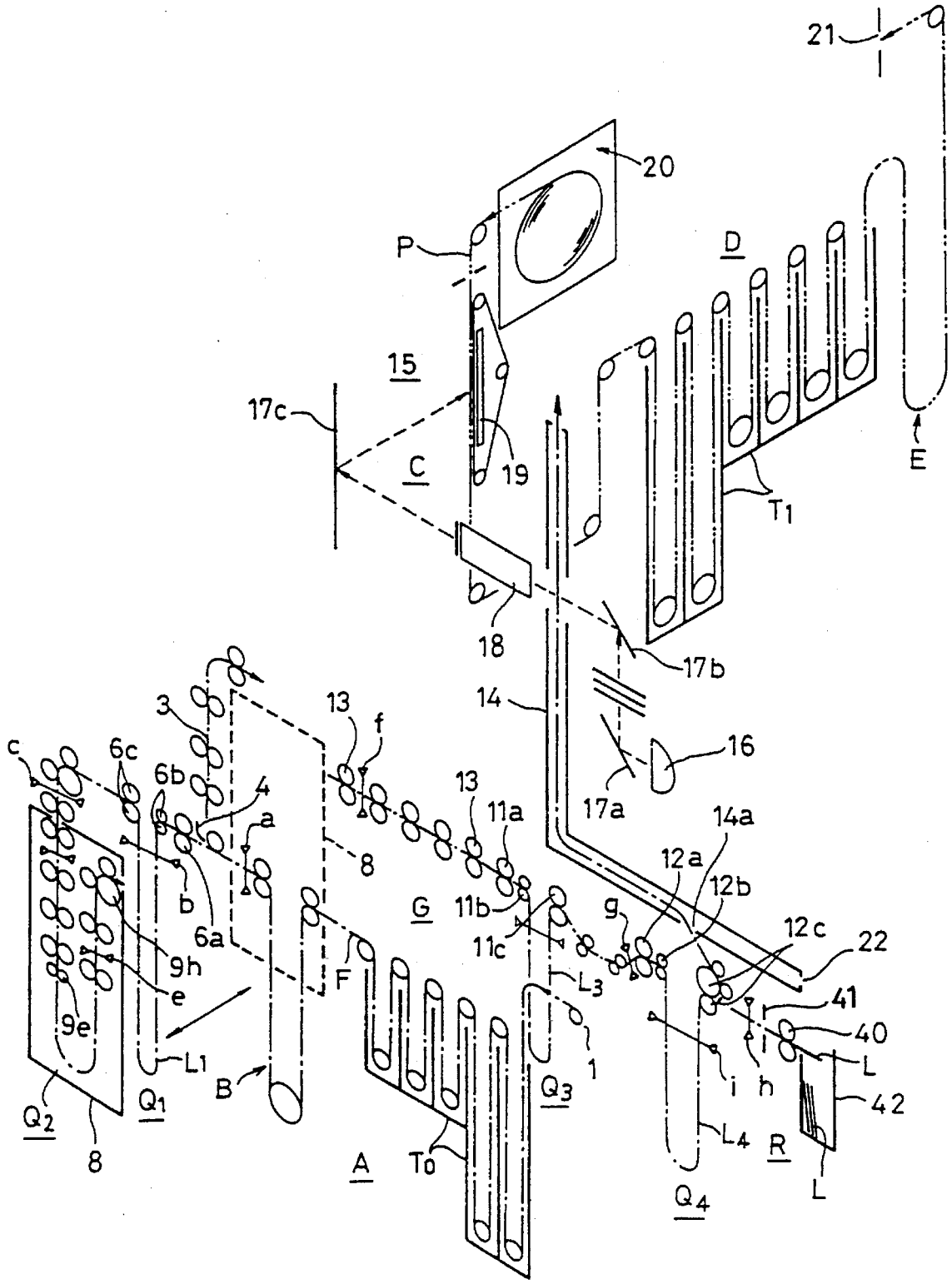
FIG. 9 is a schematic perspective view of another embodiment.

As shown in FIGS. 6 and 8, the second film stocking unit Q2 is mounted in a casing 8 movable along lateral rails 7. The film F which has been sent from the first film stocking unit Q1 is fed into the second film stocking unit Q2 through an inlet 8*a* formed in the top surface thereof. A loop L2 is formed by controlling feed rollers 9*a*, 9*b* . . .

Namely, feed rollers 9*a*, 9*b*, 9*c* and 9*d* are driven by a single common pulse motor, while feed rollers 9*f*, 9*g* and 9*h* are driven by another pulse motor. When a guide plate 9' is in the position shown by chain lines, the film F fed through the inlet 8*a* is run along a U-shaped path by synchronously driving the feed rollers 9*a* . . . 9*h*. When a sensor e detects the leading end of the film, the rollers 9*f*–9*h* are stopped for a predetermined time period, while the guide plate 9' moves back to the position shown by solid lines. The film F is looped at L2 in the casing 8 with its leading end turned forwardly by the feed roller 9*h*. The formation of the loop L2 is completed when the rear end of the film F is caught between idling press rollers 9e. On the other hand, a sensor d checks whether the film F has been completely pulled into the casing 8. The feed rollers 9*a*–9*d* are then stopped.

When one film F has been fed into the second film stocking unit Q2, the casing 8 is moved laterally by a pulse motor 10 through a belt 10*a* to the position shown by chain lines of FIG. 8 and stopped. The casing 8 is moved and stopped by controlling the number of pulses supplied to the motor 10.

In the position shown by chain lines of FIG. 5, the casing 8 is aligned with a straight feed unit G that has a path that runs parallel to the film F feed path in the film developing unit A. Thus, the film stocked in the second film stocking unit Q2 is fed out through its outlet 8b formed in the front side thereof toward the straight feed unit G. From the unit G, the film F is fed to third and then fourth film stocking units Q3 and Q4.

Figure 3:
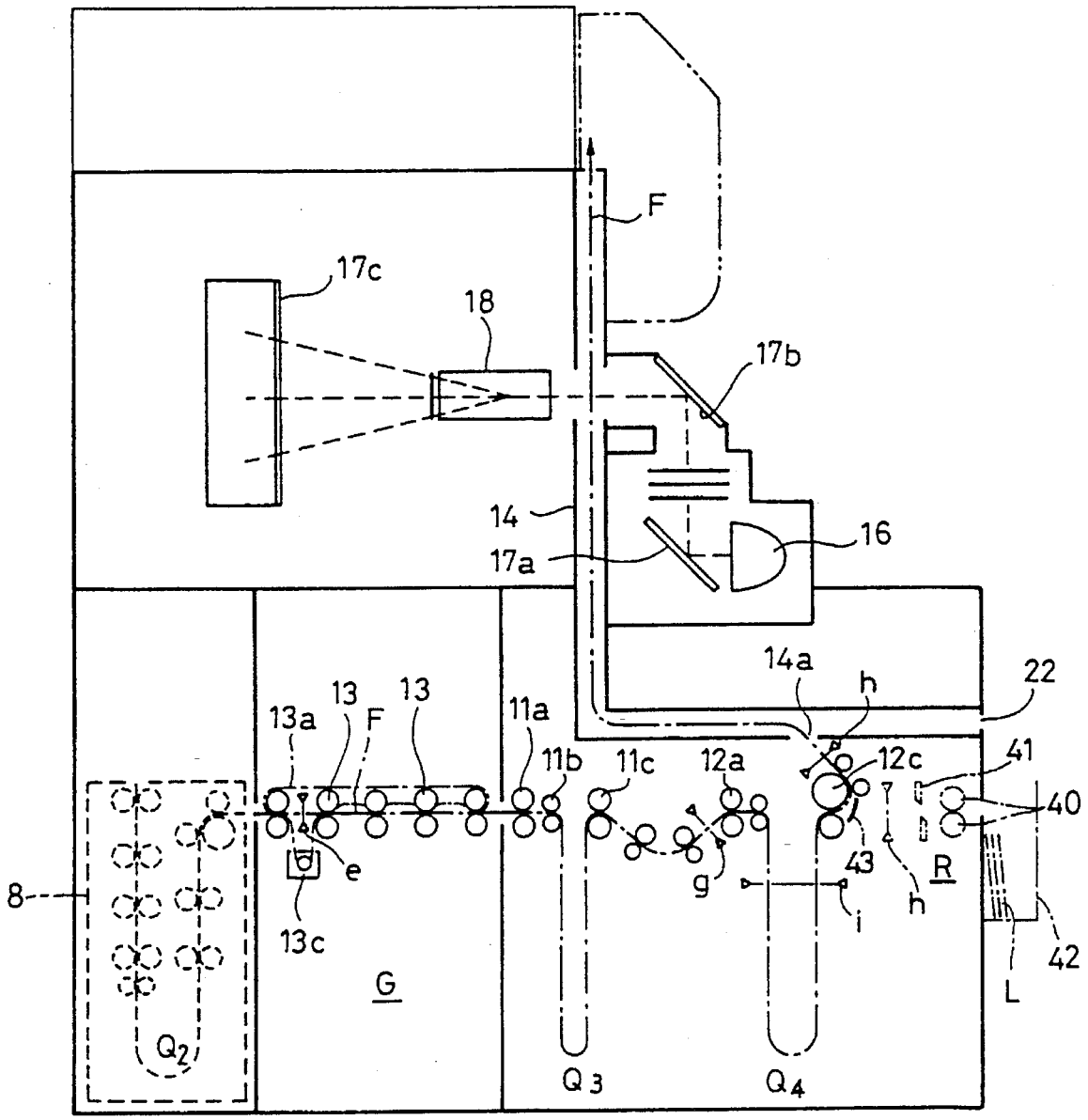
FIG. 3 is a sectional view taken along line II—II of FIG. 1.
Figure 4:
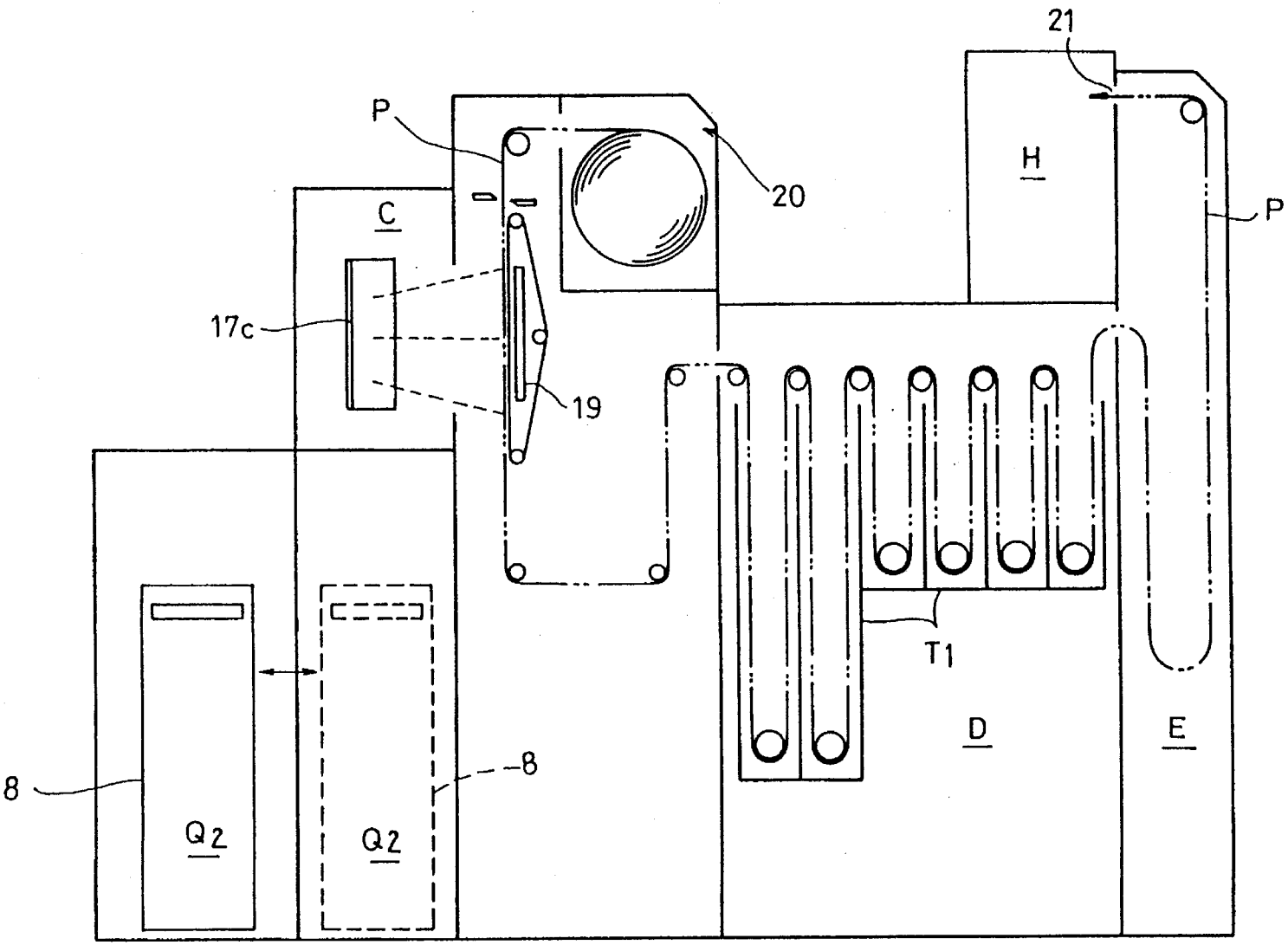
FIG. 4 is a sectional view taken along line III—III of FIG. 1.

The film F in the second film stocking unit Q2 is fed out by means of feed rollers 9*f*–9*h*. When a sensor f detects the rear end of the film F, the casing 8 is moved back to the position behind the first film stocking unit Q1 (the position shown by solid lines of FIG. 5). The straight feed unit G has a plurality of feed rollers 13 and a belt 13*a* wound therearound. The film F is fed by rotating the feed rollers 13 by a pulse motor 13*c* through the belt 13*a* (FIG. 3).

The third and fourth film stocking units Q3, Q4 have rollers 11*a*–11*c* and 12*a*–12*c* and sensors g, h and i which are similar to those of the first film stocking unit Q1 to stock films F therein. If no film F is stocked in the fourth film stocking unit Q4, a film being fed into the third film stocking unit Q3 is not stocked in the unit Q3 but is fed toward the fourth film stocking unit Q4.

Namely, the sensor i, which is similar to the sensor b, detects whether or not there is a loop L4 in the fourth film stocking unit Q4. If not, the feed rollers 11*c* keep rotating, so that the film F is fed into the fourth film stocking unit Q4 without forming a loop L3 in the unit Q3. On the other hand, if the loop L4 is detected, after the leading end of the film F is detected by the sensor g, the feed rollers 11*c* are stopped and the leading end is caught between the feed rollers 12*a*. A loop L3 is thus formed in the unit Q3 because the feed rollers 11*a* keep rotating.

When all the frames of the film F in the printing unit C are printed, this film F is discharged. Then, the film F stocked in the film stocking unit Q4 is fed toward the exposure unit 15 through an inlet 14*a* and negative mask 14 by the feed roller 12*c*, which is located behind the unit Q4.

In the exposure unit 15, the light from a light source 16 is emitted through two mirrors 17*a*, 17*b* against he film F fed into the exposure unit 15. The images on the film F are enlarged by a printing lens 18 and printed through a mirror 17*c* on photographic paper P pulled out onto an exposure table 19.

The photographic paper P is stored in a magazine 20 in the form of a roll and pulled out onto the exposure table 19. After printing, the paper P is developed by being fed through various treating solutions in a plurality of treating tanks T1 in developing unit D. The paper thus developed is then fed through drying unit E and sent out through a discharge port 21 into a sorter H.

Besides the film inlet 14*a*, the negative mask 14 has another film inlet 22 for inserting films for extra printing or make-over. Film F fed through the inlet 22 is processed in the printing unit C in exactly the same way as the films fed through the inlet 14*a*. Namely, their images are printed onto photographic paper P, which is subsequently developed and dried.

When a film F is fed into the negative mask through its inlet 22 while processing films fed through the inlet 14*a*, after discharging the film F in the printing unit C, the film in the fourth film stocking unit Q4 is not fed toward the printing unit C but is stored in the unit Q4 in the form of a loop L4. In this state, the developed film F fed into the third film stocking unit Q3 will not be sent to the unit Q4 but will be kept in the unit Q3 in the form of a loop L3. If the loop L3 is already formed in the unit Q3, the film F is stocked in the unit Q2 in the form of a loop L2. If the loop L2 is already formed in the unit Q2, the film F is stocked in the unit Q1 in the form of a loop L1. Thus, extra printing and make-over steps can be carried out without affecting the ordinary steps for developing and drying films.

Printing processes are carried out continuously thereafter. If the developing is not continuous but intermittent, irrespective of the length of interval, the portions of the film F in the film stocking units Q1–Q4 are fed one after another to the printing unit for printing.

If film F requiring a rather long time for exposure is in the printing unit C, the following film is stored in the fourth film stocking unit Q4. If a loop is already formed in the unit Q4, films are stocked in the form of loops in the film stocking units Q3, Q2 and then Q1 in the manner as described above.

Figure 13B:
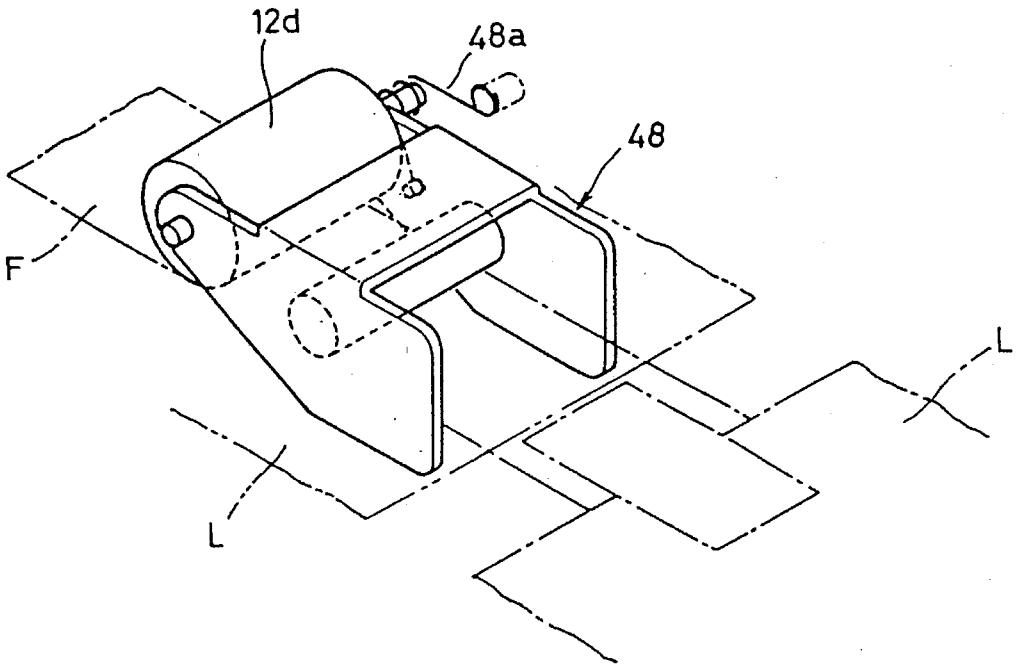
FIGS. 13A and 13B are perspective views of the film guide of the same.
Figure 14A:
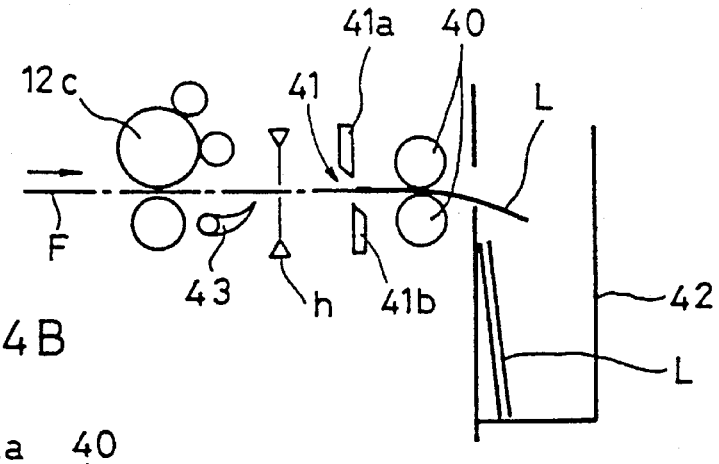
FIGS. 14A–14D are views explaining the operation of the same.
Figure 14B:
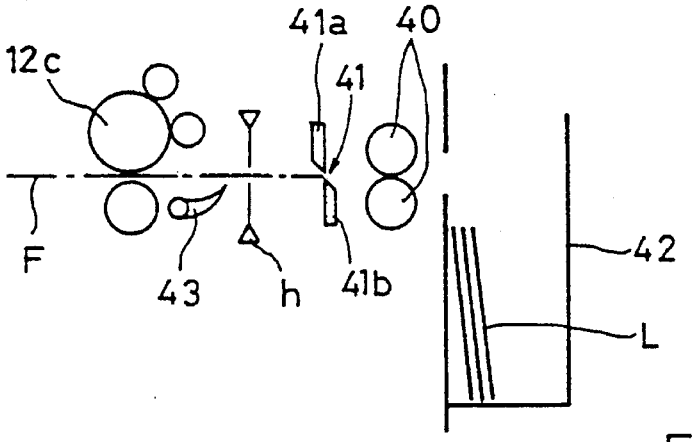
Figure 14C:
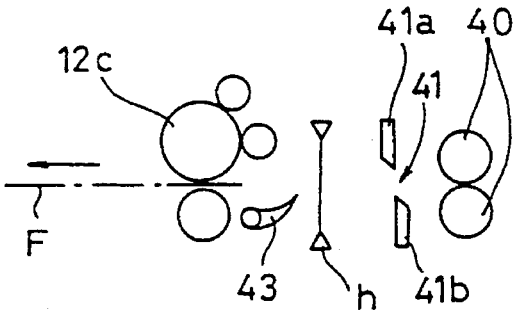
Figure 14D:
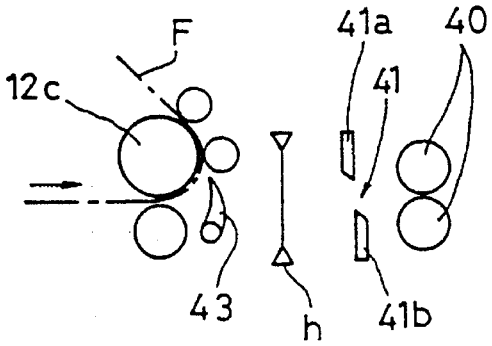
Figure 15:
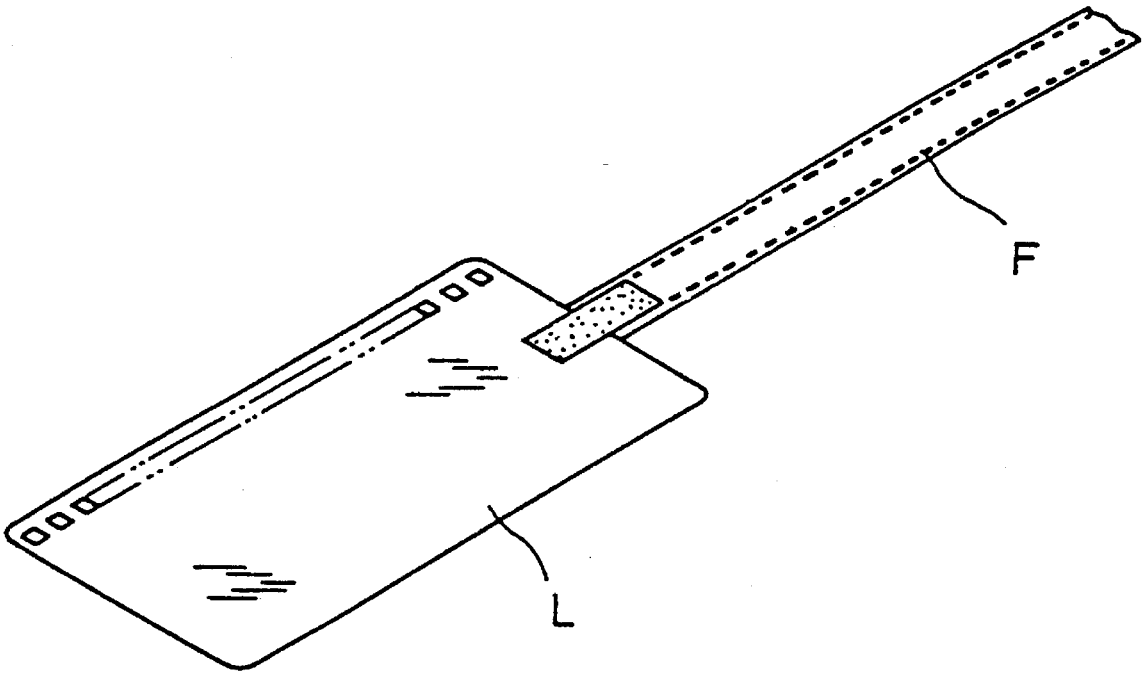
FIG. 15 is a partial perspective view of a film having a leader attached thereto.

FIGS. 9–14 show another embodiment. In this embodiment, a leader L is attached to each film F as shown in FIG. 15. This embodiment differs from the previous embodiment in the structure of the movable film stocking unit Q2 and in that a leader separating means R is provided (see chain lines in FIGS. 1 and 3).

Figure 10:
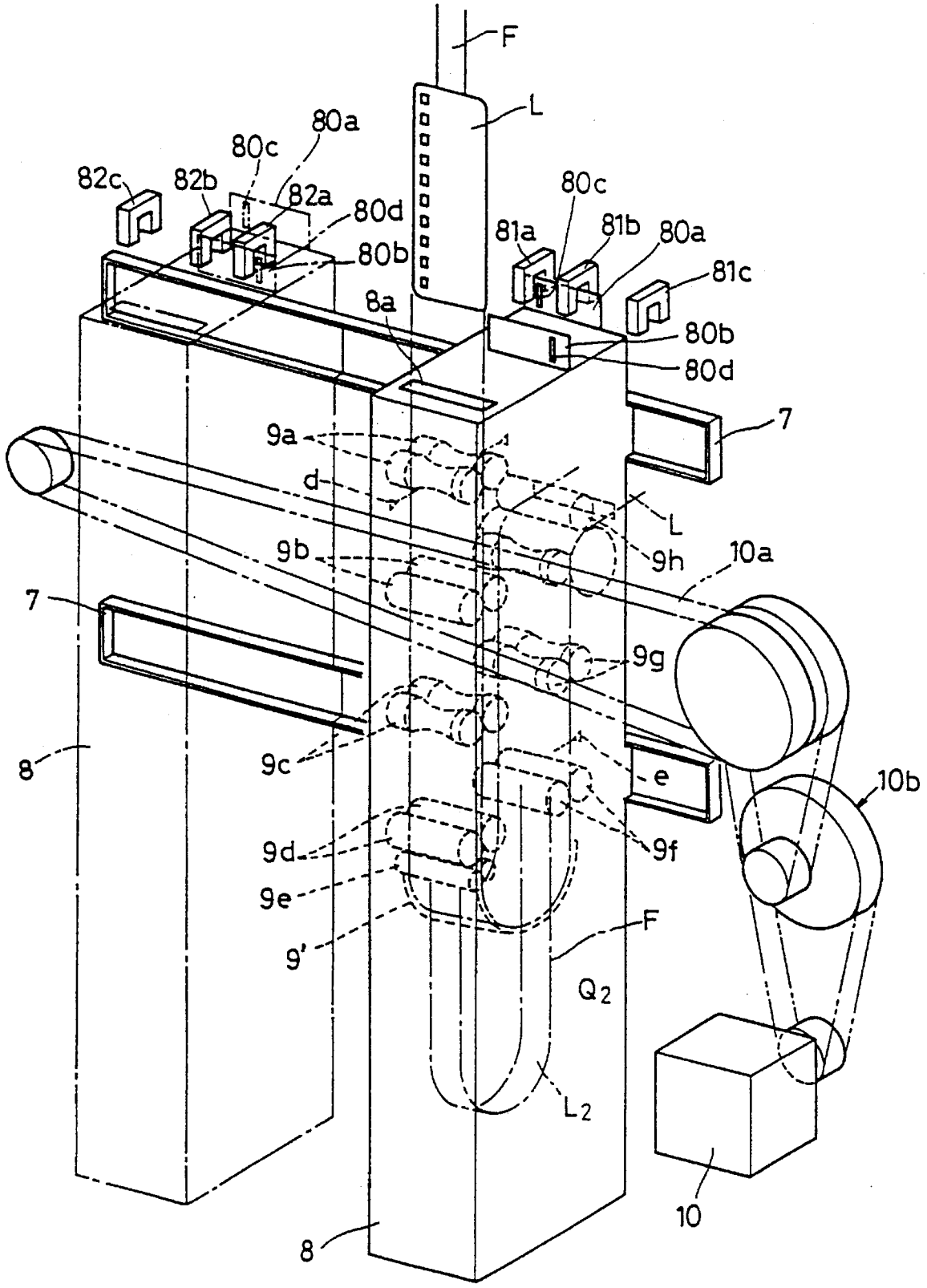
FIG. 10 is a partial perspective view of the same.
Figure 11:
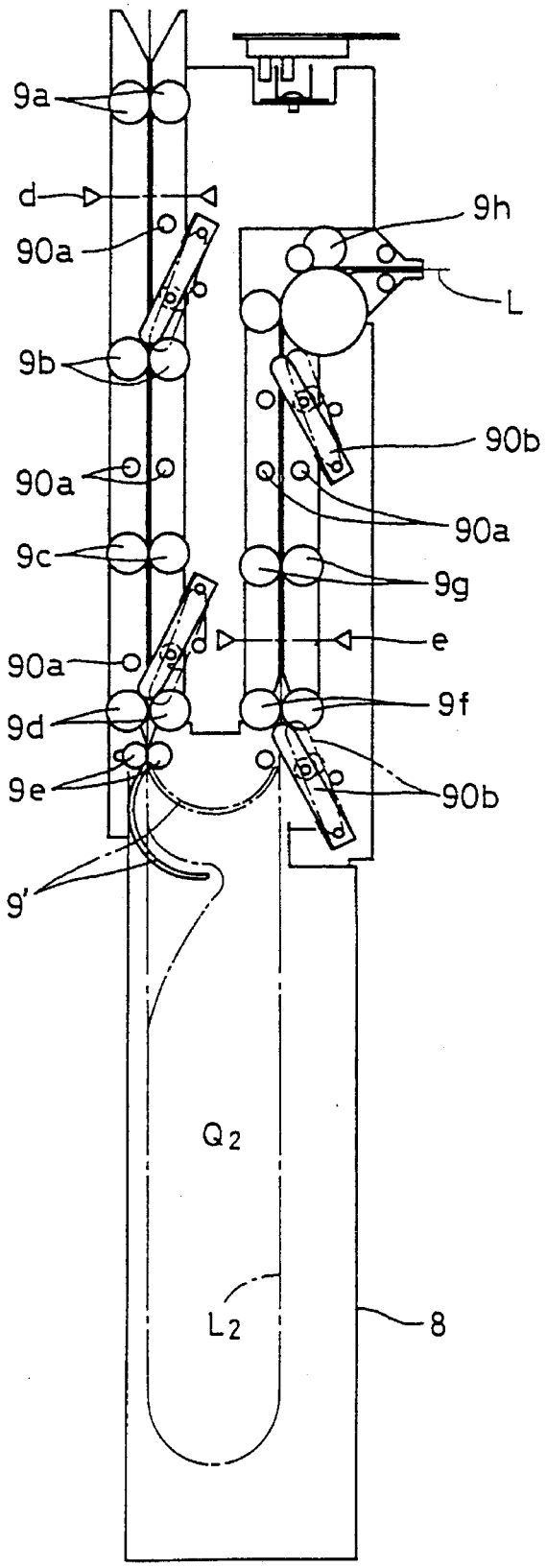
FIG. 11 is a schematic front view of a portion of the same.

Similar to the first embodiment, the film stocking unit Q2 has a plurality of feed rollers 9*a* . . . 9*h* in the casing 8 as shown in FIGS. 10 and 11. Some of these rollers are hourglass-shaped with the central portions cut away as shown in FIG. 10. Since films F are fed through such central cut-away portions, they hardly touch these hourglass-shaped rollers. Since the leader L is wider than the cut-away portions, it is fed sandwiched between the feed rollers 9*a* . . . Predetermined ones of the other feed rollers 13, 12*a*, 11*a* . . . in this embodiment are also hourglass-shaped with their central portions cut away.

Figure 13A:
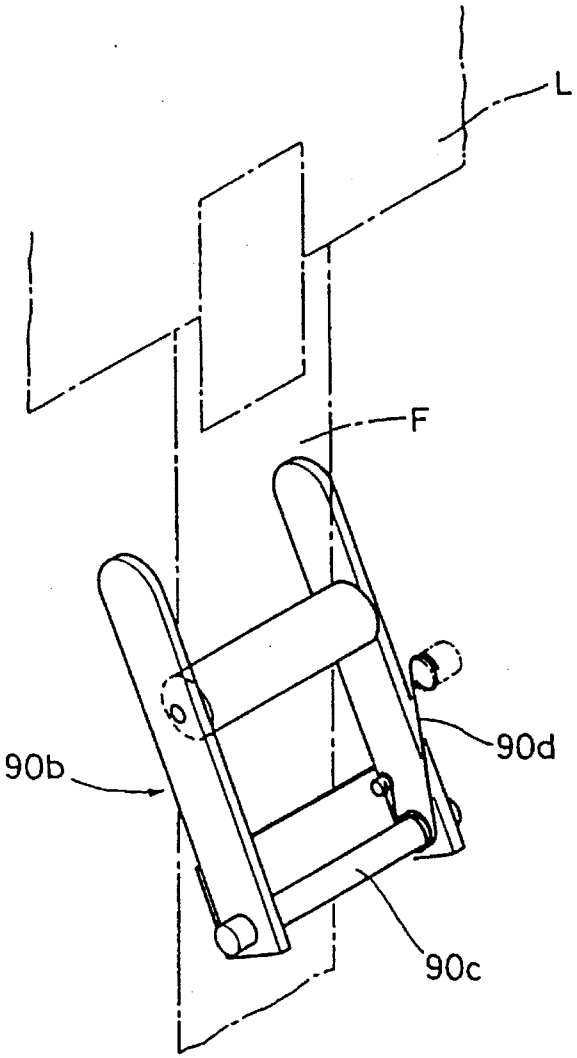

Though not shown in FIG. 10, cylindrical auxiliary rollers 90*a* and film guides 90*b* are provided in the casing 8 as shown in FIG. 11. As shown in FIG. 13A, each film guide 90*b* is pivotally mounted on a support shaft 90*c* secured to a base e.g. the casing 8. Normally, the guides 90*b* are urged to the position shown by solid lines in FIG. 11 by springs 90*d* to guide the film F as shown in FIG. 13A. Upon contact with the leader L, they are swung back as shown by chain lines in FIG. 11, allowing the passage of the leader to pass.

The casing 8 is moved by a pulse motor 10 through a speed reducer 10*b* and a belt 10*a*. The casing 8 carries on its top two parallel detection plates 80*a* and 80*b*. Three sensors each 81*a*, 81*b* and 81*c* and 82*a*, 82*b* and 82*c* are provided along the respective travel paths of the detection plates 80*a* and 80*b*. While the detection plates 80*a*, 80*b* are passing through between the respective sensors 81*a* . . . , 82*a*. . . , they are turned off because the lights transmitted across the respective sensors are blocked by the detection plates 80*a*, 80*b*.

When the detection plates 80*a*, 80*b* move into between the first sensors 81*a*, 82*a*, blocking the lights transmitted thereaross, they are turned off. When the detection plates move further ahead and between the second sensors 81*b*, 82*b*, they are turned off. When slits 80*c*, 80*d* formed in the respective detection plates 80*a*, 80*b* are located between the first sensors 81*a*, 82*a*, the first sensors are turned on. In this position, i.e. the position in which the first sensors 81*a*, 82*a* are on and the second sensors 81*b*, 82*b* are off, the pulse motor 10 is stopped. The casing 8 is thus maintained in this position. If the casing 8 should overrun, thus turning the third sensors 81*c*, 82*c* off, the pulse motor 10 will be turned in reverse direction to move the casing 8 back until the first sensors 81*a*, 82*a*, which have been turned on and then off, are turned back on again (until the slits 80*c*, 80*d* move into between the first sensors again). Thus, the third sensors 81*c*, 82*c* detect the respective ends of the casing 8.

Figure 12:
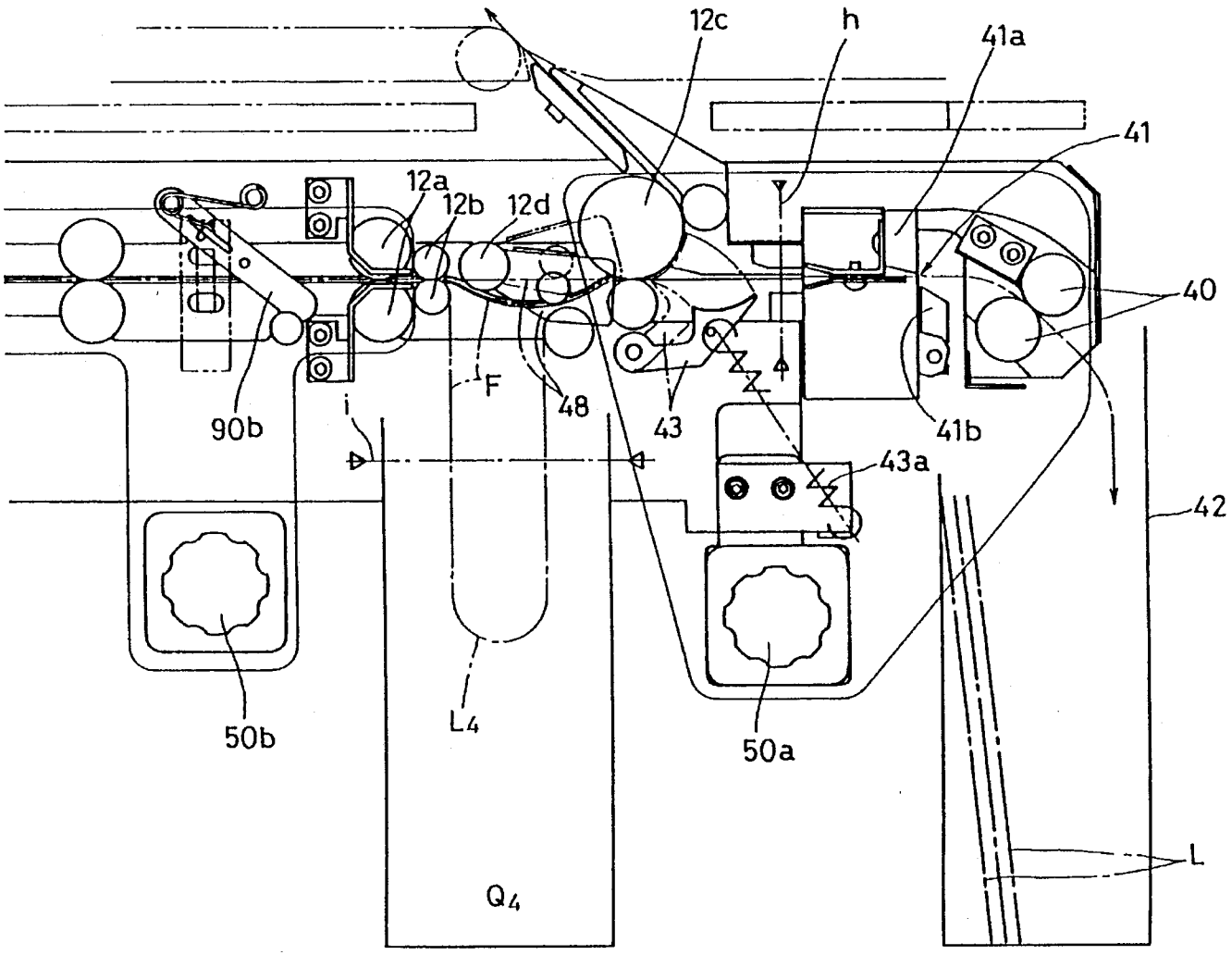
FIG. 12 is a schematic front view of a portion of the same.

As shown in FIGS. 12–14, the leader separating means R comprises a cutter 41 made up of upper and lower blades 41*a*, 41*b*, a leader stocker 42 and a guide 43. A film F having a leader L which has been attached thereto is fed until its end protrudes from delivery rollers 40 as shown in FIGS. 12 and 14A and then cut by the cutter 41 as shown in FIG. 14B to separate the leader L from the film. The cutter 41 is activated when the feed rollers 12*c* have turned a predetermined time period after detecting of the leader L by the sensor h. The leader L thus cut apart is fed by the delivery rollers 40 and dropped into the leader stocker 42.

The guide 43, provided near the feed rollers 12*c*, is kept out of the film feed path, allowing smooth feed of the leader L (film F). When the leader L is cut apart and dropped into the leader stocker 42, the feed rollers 12*c* turn in reverse, rewinding the film F to the position shown in FIG. 14C. The guide 43 is erected in this state as shown in FIG. 14D. Then, the film F is fed forward again and turned upwards by the guide 43. The guide 43 is moved out of the film feed path by a rotary solenoid provided coaxially with the shaft of the guide 43 and returned to the erect position by a spring 43*a*. The delivery rollers 40 and feed rollers 12*c* are driven by a pulse motor 50*a*, while the feed rollers 12*a* are driven by a pulse motor 50*b*.

In FIG. 12, numeral 48 indicates a film guide for bending the film F downwards. As shown in FIG. 13B, it is pivotally mounted on a guide roller 12*d*. Normally, it is kept in the position shown by solid lines in FIG. 12 by a spring 48*a*. When the leader L is inserted under the film guide 48 as shown by two-dot chain lines in FIG. 13B, the film guide 48 is raised to the position shown by chain lines in FIG. 12. When the film F is subsequently inserted under the film guide 48 as shown by chain lines in FIG. 13B, the film guide 48 will return to the position shown by solid lines in FIG. 12 because the film is narrower than the leader L. The film F is thus bent downwards. Thus, by feeding the film by the feed rollers 12*a*, the loop L4 as shown by chain a line in FIG. 12 can be formed smoothly. Similar film guides 48 should be provided in the other film stocking units Q1 . . .

Similar to the first embodiment, when all the frames on the film F in the film printing unit C have been printed, the film will be discharged and the feed roller 12*c*, which is located behind the fourth film stocking unit Q4, feeds the film F kept in the unit Q4 (with its leading end turned upwards as shown in FIG. 14D) to the exposure unit 15 through the negative mask 14. The images on the film F are then printed onto photographic paper.

In the above embodiments, the film feed path is divided into two parts that extend parallel to each other in a single plane by providing the movable second film stocking unit Q2. Thus, in spite of the fact that there are provided a plurality of film stocking units Q1–Q4, the entire device is not very large because the film feed path is not a straight path.

Figure 16:
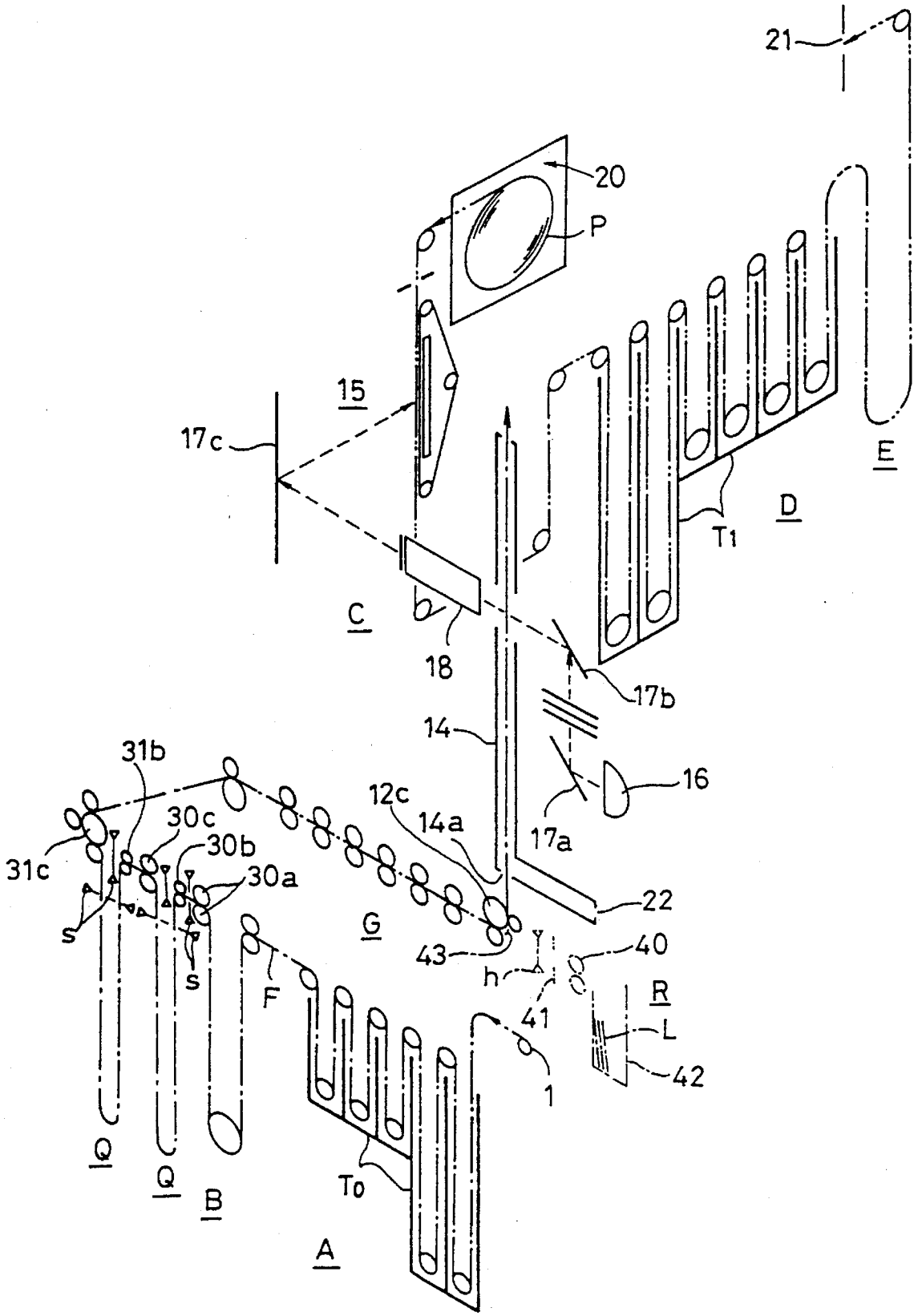
FIG. 16 is a schematic perspective view of another embodiment.
Figure 17:
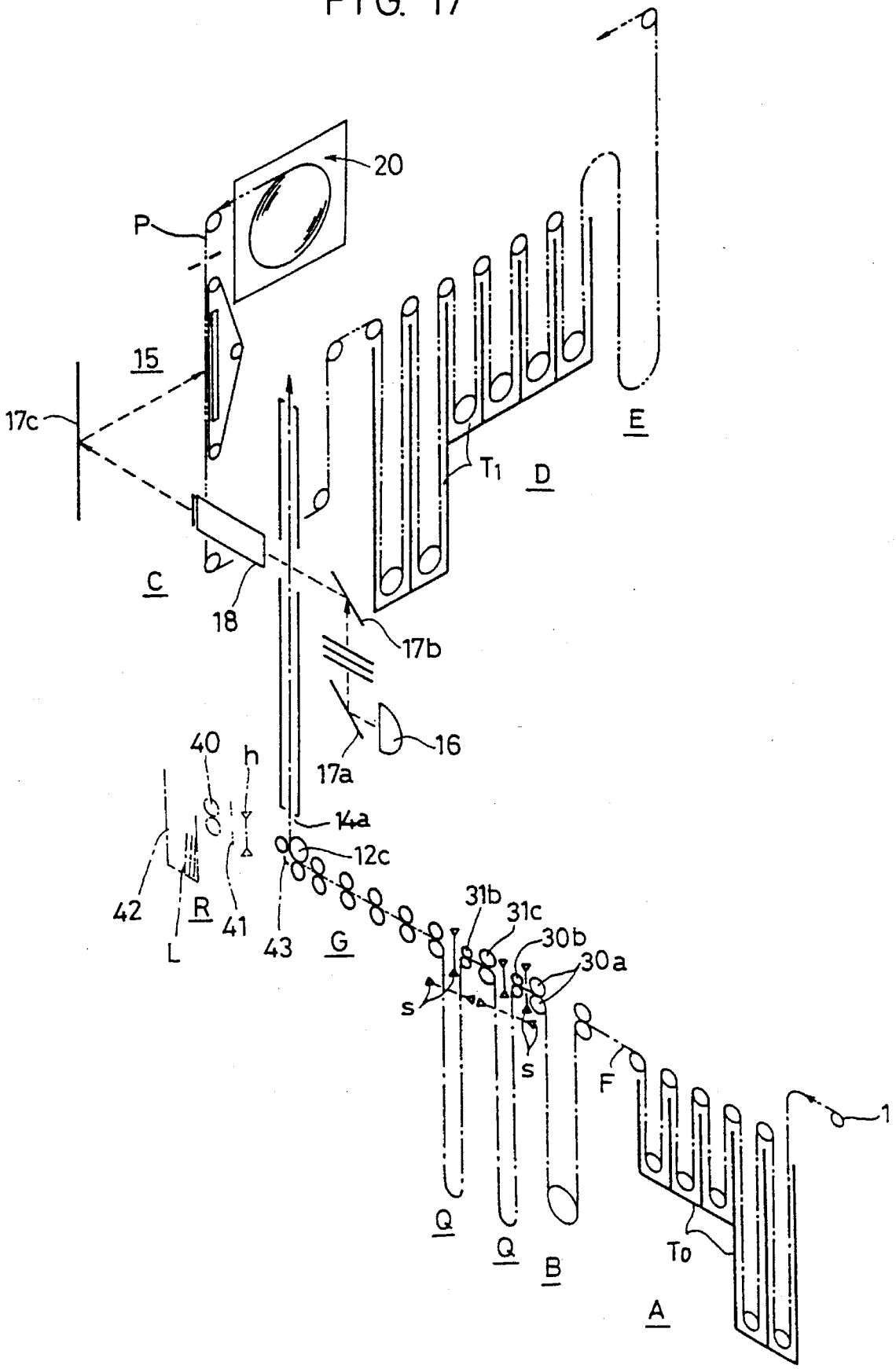
FIG. 17 is a schematic perspective view of another embodiment.
Figure 18:
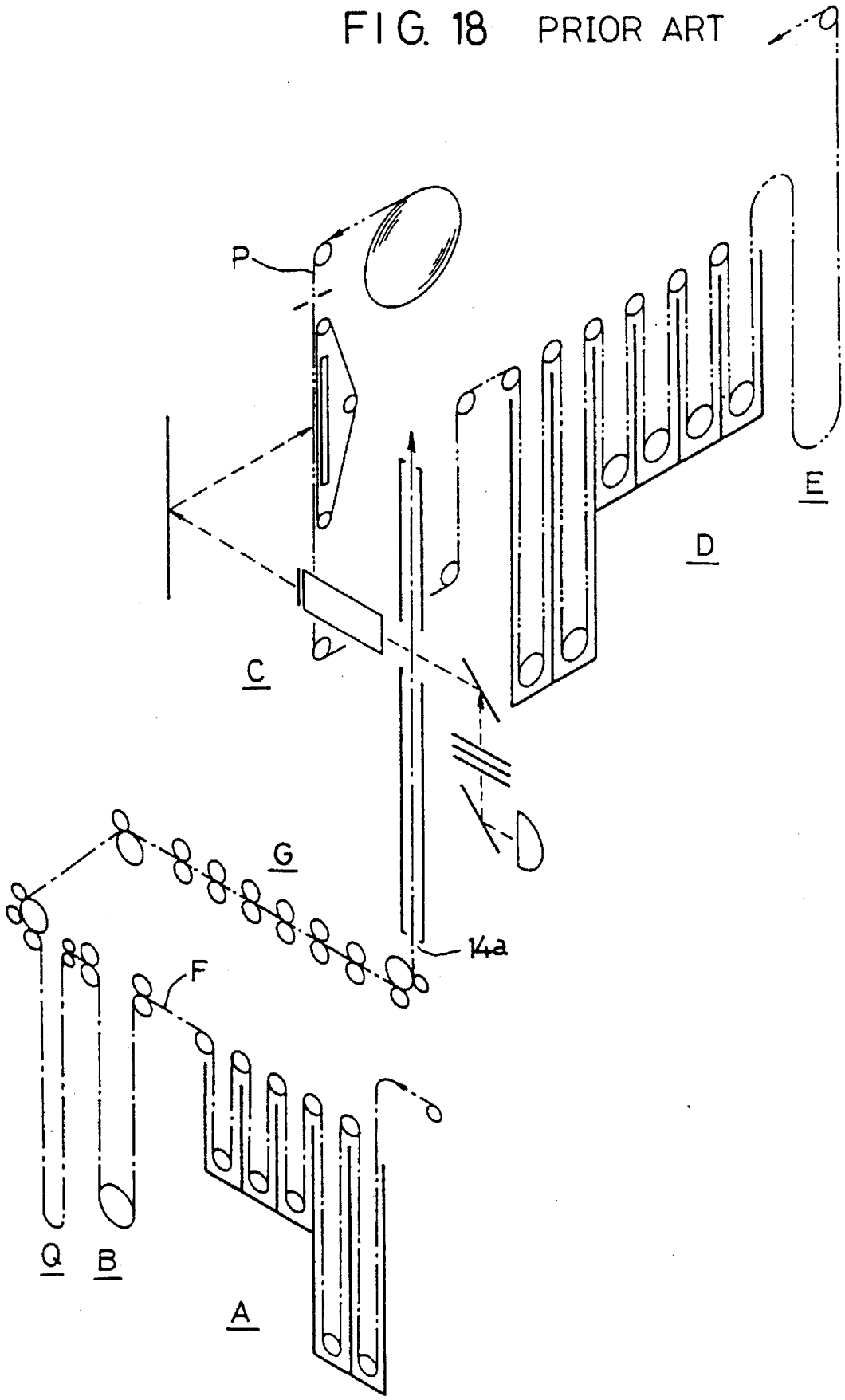
FIG. 18 PRIOR ART
FIG. 18 is a schematic perspective view of the prior art.
Figure 19:
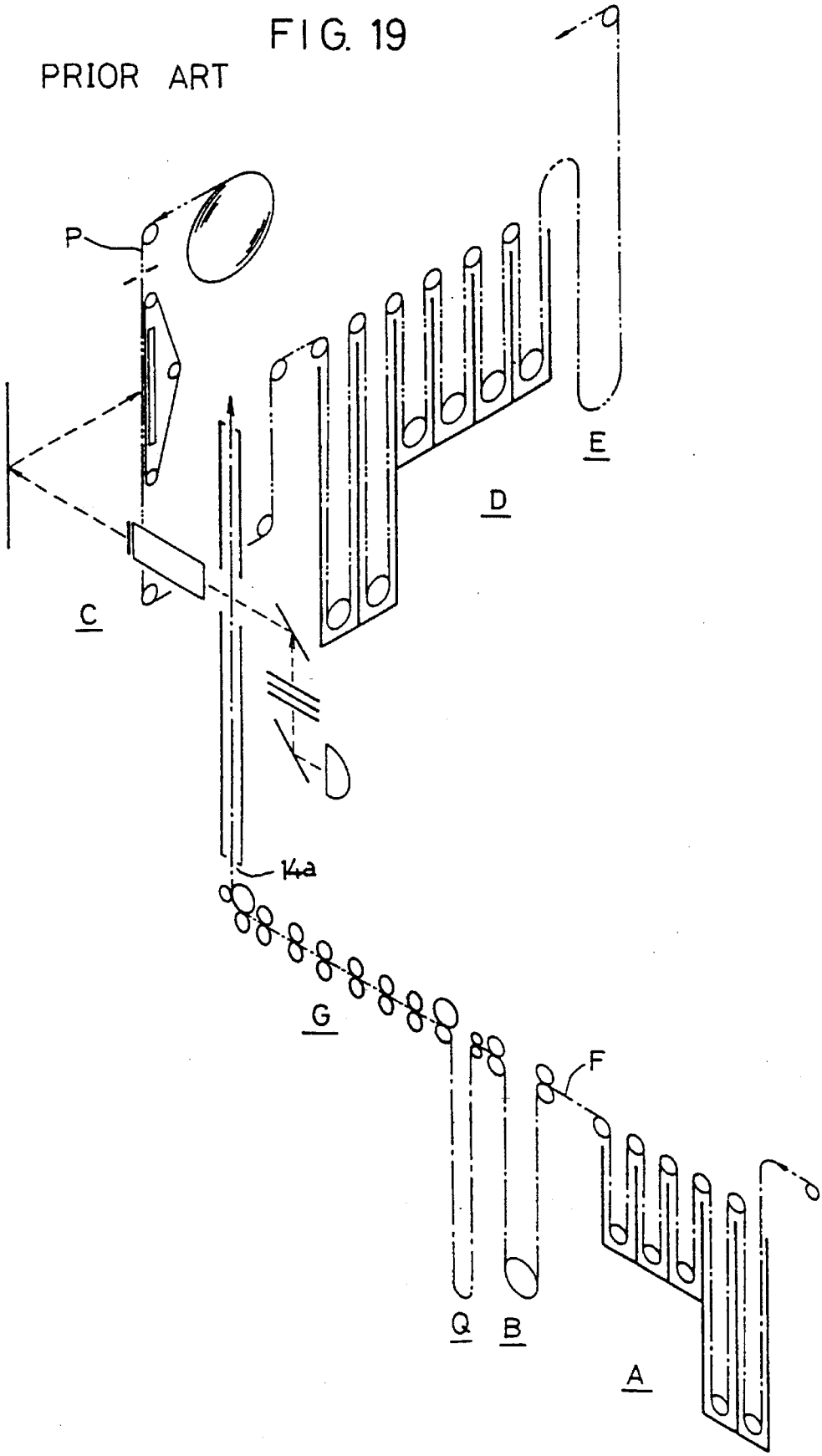
FIG. 19 PRIOR ART
FIG. 19 is a schematic perspective view of the prior art.

Also, as shown in FIGS. 16 and 17 (chain lines indicate the leader separating means R), the abovementioned advantages are achievable when additional film stocking units Q are provided behind the film stocking units Q in the device shown in FIGS. 18 and 19. Instead of providing two each feed rollers 11*a*, 11*c* and 12*a*, 12*c* between the third and fourth film stocking units Q3 and Q4, one pair of rollers 11*c* and 12*a* may be commonly used for both units Q3 and Q4. Namely, each of the units Q3 and Q4 may comprise two feed rollers 30*a* and 30*c*. In the figures, numerals 30*b* and 31*b* indicate free press rollers and s indicates sensors. In the embodiments shown in these figures, the path of the straight feed unit G is in a vertical plane that contains the film developing unit A and the film drying unit B.

In the above embodiments, the path of the straight feed unit G is used simply to feed films. But this portion also may be used as an extra film stocking unit by providing a sensor similar to those provided in the other film stocking units and replacing the feed rollers 13 with ones which can be selectively turned on and off. With this arrangement, it is possible to stock a film in the feed unit G by temporarily stopping the feed of the film and also stopping the feed of the film in the second film stocking unit Q2.

In any of the embodiments, the number of film stock units and their positions are not limited. For example, an extra film stocking unit may be provided in the straight film feed unit G.

What is claimed is:

1. A photographic processing machine comprising a film developing unit, a film drying unit, a printing unit, a photographic paper developing unit and a photographic paper drying unit, wherein a film having a leader attached to the leading end thereof is fed through said film developing unit and said film drying unit to develop and dry the film, and wherein photographic paper is fed through said printing unit, photographic paper developing unit and photographic paper drying unit to print images on the film onto the photographic paper and to develop and dry the photographic paper, said machine further comprising:

a plurality of film stocking units provided in a film feed path from said film drying unit to said printing unit, each said film stocking unit having two pairs of feed rollers which can be driven independently of each other for selectively stocking a film or feeding a film ahead without stocking; and means, provided upstream of said printing unit, for separating the leader from the film.

2. A photographic processing machine as claimed in claim 1, wherein a film inlet formed in said film developing unit, said film developing unit and said film drying unit are arranged along a straight line, a film feed path is provided parallel to the straight line that extends through said film developing unit and film drying unit, one of said film stocking units is provided downstream of said film drying unit and is movable along an axis aligned with said film feed path, said film feed path extends to a film inlet formed in said printing unit, and other of said film stocking units being provided in said film feed path.

3. A photographic processing machine as claimed in claim 2, wherein said printing unit has an additional film inlet for inserting films for extra printing or make-over.

4. A photographic processing machine as claimed in claim 1, wherein said printing unit has a film inlet for inserting films for extra printing or make-over.

* * * * *